US011118347B2

(12) United States Patent
Sievers et al.

(10) Patent No.: US 11,118,347 B2
(45) Date of Patent: Sep. 14, 2021

(54) HIGH PERFORMANCE WALL ASSEMBLY

(75) Inventors: Michael J. Sievers, Mullica Hill, NJ (US); Michael J. McNulty, Charlotte, NC (US); Michael Drewery, Monroe, NC (US); Rick Davenport, Fort Mill, SC (US); Mary Poma, Pleasant Ridge, MI (US); Paul J. Fox, Saline, MI (US); Colby A. Swanson, Jersey City, NJ (US)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 14/126,721

(22) PCT Filed: Jun. 15, 2012

(86) PCT No.: PCT/US2012/042667
§ 371 (c)(1),
(2), (4) Date: Dec. 16, 2013

(87) PCT Pub. No.: WO2012/174377
PCT Pub. Date: Dec. 20, 2012

(65) Prior Publication Data

US 2014/0115991 A1 May 1, 2014

Related U.S. Application Data

(60) Provisional application No. 61/498,090, filed on Jun. 17, 2011.

(51) Int. Cl.
*E04B 2/56* (2006.01)
*E04C 2/38* (2006.01)
(Continued)

(52) U.S. Cl.
CPC ..... *E04B 2/562* (2013.01); *E04B 1/665* (2013.01); *E04C 2/205* (2013.01); *E04C 2/386* (2013.01); *E04B 1/10* (2013.01)

(58) Field of Classification Search
CPC . E04B 1/14; E04B 1/80; E04B 1/7604; E04B 1/762; B32B 5/18; E04D 11/02; Y10T 428/249985; Y10T 428/233
(Continued)

(56) References Cited

U.S. PATENT DOCUMENTS 1,028,725 A 6/1912 Hodgson
1,549,292 A * 8/1925 Buttress ..... 52/446
(Continued)

FOREIGN PATENT DOCUMENTS

BE 1010844 A3 2/1999
CA 2019852 A1 12/1990
(Continued)

OTHER PUBLICATIONS

Brochure, "Modular Wall Panel Technology" extracted from WWW.nu-techbuildingsystems.com/modular_panel_technology.php on Aug. 23, 2010, 7 pages.
(Continued)

*Primary Examiner* — Basil S Katcheves
*Assistant Examiner* — Omar F Hijaz
(74) *Attorney, Agent, or Firm* — DLA Piper LLP (US)

(57) ABSTRACT

A high performance wall assembly receives an exterior covering of a building. The high performance wall assembly includes a frame assembly having a top member, a bottom member opposite the top member, and a plurality of vertical members. The vertical members are coupled to and extend between the top and bottom members. The high performance wall assembly also includes a rigid foam insulating panel coupled to the frame assembly. A structural foam layer is
(Continued)

disposed on the plurality of vertical members and on the rigid foam insulating panel. The structural foam layer couples the rigid foam insulating panel to the frame assembly and couples the plurality of vertical members to the top and bottom members such that the high performance wall is free of fasteners.

16 Claims, 8 Drawing Sheets

(51) Int. Cl.
*E04B 1/66* (2006.01)
*E04C 2/20* (2006.01)
*E04B 1/10* (2006.01)

(58) Field of Classification Search
USPC ..... 52/309.7–309.9, 309.16, 481.1, 481.2, 52/403.7, 443–446, 454
See application file for complete search history.

(56) References Cited

U.S. PATENT DOCUMENTS 2,015,817 A 4/1926 Schmidt
1,637,410 A * 8/1927 Coryell ..... 52/446
1,914,345 A 7/1932 Roos
2,116,270 A 5/1938 Le Grand
2,318,820 A 5/1943 Voigt et al.
2,324,971 A 7/1943 Woodward
2,514,170 A 7/1950 Walter et al.
2,553,881 A 5/1951 Suttles
2,645,824 A 7/1953 Titsworth
2,755,728 A 7/1956 Frisby
2,767,961 A 10/1956 Frankland
2,876,871 A 3/1959 Coffman et al.
3,006,113 A 10/1961 Barnes et al.
3,086,323 A 4/1963 Pine
3,115,819 A 12/1963 Mahlmeister et al.
3,147,336 A 9/1964 Mathews
3,160,987 A 12/1964 Pinkley
3,196,773 A 7/1965 Lorenz et al.
3,251,163 A 5/1966 Russell
3,258,889 A 7/1966 Butcher
3,295,278 A 1/1967 Muhm
3,343,474 A 9/1967 Sohda et al.
3,368,473 A 2/1968 Sohda et al.
3,482,367 A 12/1969 Curran
3,595,728 A 7/1971 Robson
3,605,365 A 9/1971 Hastings
3,616,139 A 10/1971 Jones
3,633,659 A 1/1972 Ohlsson
3,683,785 A 8/1972 Grange
3,736,715 A 6/1973 Krumwiede
3,748,803 A 7/1973 Widerby et al.
3,756,895 A 9/1973 Bellamy
3,780,638 A 12/1973 Burghartz et al.
3,783,563 A 1/1974 Moore
3,785,913 A * 1/1974 Hallamore ..... 428/71
3,789,747 A 2/1974 Wasserman et al.
3,797,180 A 3/1974 Grange
3,816,234 A * 6/1974 Winfield ..... 428/317.9
3,868,796 A 3/1975 Bush
3,885,008 A 5/1975 Martin
3,952,471 A 4/1976 Mooney
3,972,164 A 8/1976 Grange
3,982,360 A 9/1976 Newman
4,019,297 A 4/1977 Murphy
4,028,289 A 6/1977 Brown
4,047,355 A 9/1977 Knorr
4,057,123 A 11/1977 Erickson
4,067,155 A * 1/1978 Ruff et al. ..... 52/105
4,069,628 A 1/1978 Kreimer
4,080,881 A 3/1978 Campbell
4,096,790 A 6/1978 Curran
4,099,355 A 7/1978 Strunk
4,102,092 A 7/1978 Ward
4,104,840 A 8/1978 Heintz et al.
4,125,971 A 11/1978 Ward
4,185,437 A 1/1980 Robinson
4,201,121 A 5/1980 Brandenburg, Jr.
4,214,510 A 7/1980 Ward
4,223,489 A 9/1980 Bentley
4,237,672 A 12/1980 Peterson
4,254,598 A 3/1981 Rugroden
4,286,420 A 9/1981 Pharmakidis
4,295,304 A 10/1981 Kim
4,308,308 A 12/1981 Sachse
4,333,290 A 6/1982 Koberstein
4,344,413 A 8/1982 Watkins et al.
4,346,541 A 8/1982 Schmitt
4,382,435 A 5/1983 Brill-Edwards
4,397,122 A 8/1983 Cros
4,429,503 A 2/1984 Holliday
4,446,661 A 5/1984 Jonsson et al.
4,453,359 A 6/1984 Robinson
4,471,591 A * 9/1984 Jamison ..... 52/309.9
4,593,511 A 6/1986 Hakasaari
4,635,419 A 1/1987 Forrest
4,637,190 A 1/1987 Minialoff et al.
4,641,469 A 2/1987 Wood
4,660,463 A 4/1987 Bottomore et al.
4,661,533 A 4/1987 Stobby
4,677,903 A 7/1987 Mathews, III
4,683,688 A 8/1987 Wojcinski
4,698,366 A 10/1987 Laan
4,736,561 A 4/1988 Lehr et al.
4,754,587 A 7/1988 Glaser
4,832,308 A 5/1989 Slonimsky et al.
4,852,314 A 8/1989 Moore, Jr.
4,858,403 A 8/1989 Lingle
4,916,875 A 4/1990 Kashiwagi
4,942,711 A 7/1990 Bergquist
4,960,184 A 10/1990 Woodward et al.
4,995,308 A 2/1991 Waggoner
5,009,043 A 4/1991 Kurrasch
5,033,248 A 7/1991 Phillips
5,102,260 A 4/1992 Horvath et al.
5,172,532 A 12/1992 Gibbar, Jr.
5,192,598 A * 3/1993 Forte et al. ..... 428/71
5,224,315 A * 7/1993 Winter, IV ..... 52/309.8
5,268,226 A * 12/1993 Sweeney ..... B28B 1/522 248/346.02
5,279,089 A 1/1994 Gulur
5,293,728 A 3/1994 Christopher et al.
5,327,699 A 7/1994 Khan et al.
5,341,612 A 8/1994 Robbins
5,373,678 A 12/1994 Hesser
5,425,207 A 6/1995 Shayman
5,425,908 A 6/1995 Merser
5,426,908 A 6/1995 Shayman
5,433,050 A 7/1995 Wilson et al.
5,473,847 A 12/1995 Crookston
5,487,247 A 1/1996 Pigg
5,497,589 A 3/1996 Porter
5,509,242 A 4/1996 Rechsteiner et al.
5,522,195 A 6/1996 Bargen
5,526,629 A 6/1996 Cavaness
5,533,311 A 7/1996 Tirrell et al.
5,596,847 A 1/1997 Stephenson
5,600,928 A 2/1997 Hess et al.
5,612,117 A 3/1997 Belanger et al.
5,644,878 A 7/1997 Wehrmann
5,743,055 A 4/1998 Conner et al.
5,758,463 A 6/1998 Mancini, Jr.
5,761,864 A 6/1998 Nonoshita
5,765,330 A 6/1998 Richard
5,766,071 A 6/1998 Kirkwood
5,771,645 A 6/1998 Porter
5,771,654 A 6/1998 Moore et al.
5,787,665 A * 8/1998 Carlin ..... E04C 2/384 52/309.11
5,806,264 A 9/1998 Boot
5,860,259 A 1/1999 Laska

(56) References Cited

U.S. PATENT DOCUMENTS 5,884,446 A 3/1999 Hageman
5,910,082 A 6/1999 Bender et al.
5,943,775 A * 8/1999 Lanahan ..... B26D 1/553 264/142
5,953,883 A 9/1999 Ojala
6,026,629 A 2/2000 Strickland et al.
6,032,434 A * 3/2000 Graf ..... 52/794.1
6,041,561 A 3/2000 LeBlang
6,061,973 A 5/2000 Accardi et al.
6,061,978 A 5/2000 Dinwoodie et al.
6,067,770 A 5/2000 Lubker, II et al.
6,085,469 A 7/2000 Wolfe
6,085,485 A 7/2000 Murdock
6,088,992 A 7/2000 Nunley
6,099,768 A 8/2000 Strickland et al.
6,122,879 A 9/2000 Montes
6,125,608 A * 10/2000 Charlson ..... E04B 1/7604 52/404.1
6,141,932 A 11/2000 Tarrant
6,185,895 B1 2/2001 Rettew
6,212,837 B1 4/2001 David et al.
6,220,956 B1 4/2001 Kilian et al.
6,226,943 B1 * 5/2001 Grinshpun ..... E04B 1/80 52/309.4
6,279,287 B1 8/2001 Meadows
6,279,290 B1 8/2001 Richardson
6,279,293 B1 8/2001 Ojala
6,280,669 B2 8/2001 Kistner et al.
6,305,142 B1 10/2001 Brisson et al.
6,383,652 B1 5/2002 Templeton et al.
6,401,417 B1 6/2002 Leblang
6,415,580 B2 7/2002 Ojala
6,519,904 B1 2/2003 Phillips
6,571,523 B2 6/2003 Chambers
6,588,172 B2 7/2003 Porter
6,589,660 B1 7/2003 Templeton et al.
6,619,008 B1 9/2003 Shivak et al.
6,662,516 B2 * 12/2003 Vandehey ..... E04B 1/7604 52/309.5
6,688,059 B1 2/2004 Walker
6,688,073 B2 2/2004 VanderWerf et al.
6,715,249 B2 4/2004 Rusek et al.
6,729,094 B1 5/2004 Spencer et al.
6,772,569 B2 8/2004 Bennett et al.
6,780,099 B1 8/2004 Harper
6,789,645 B1 9/2004 Deblander
6,802,157 B2 10/2004 Hallsten
6,854,230 B2 2/2005 Starke
6,869,661 B1 3/2005 Ahr
6,886,301 B2 5/2005 Schilger
6,941,706 B2 9/2005 Austin et al.
7,143,557 B1 12/2006 Ayers, Jr.
7,165,369 B2 1/2007 Jandl
7,168,216 B2 1/2007 Hagen, Jr.
7,247,090 B2 7/2007 Vacek
7,398,856 B2 7/2008 Foster et al.
7,543,419 B2 6/2009 Rue
7,574,837 B2 8/2009 Hagen, Jr. et al.
7,591,109 B2 9/2009 Rotter
7,610,729 B1 11/2009 Ayers, Jr.
7,735,267 B1 6/2010 Ayers, Jr.
7,749,598 B2 * 7/2010 Agrawal ..... 428/305.5
7,765,750 B2 8/2010 Duncan
7,765,756 B2 8/2010 Bontrager, II
7,810,296 B1 10/2010 Turku
7,818,922 B2 10/2010 Ellis
7,926,233 B2 4/2011 Schiffmann et al.
7,946,384 B2 5/2011 Foster et al.
8,024,894 B1 9/2011 Ayers, Jr.
8,100,341 B1 1/2012 Roderick et al.
8,104,245 B2 * 1/2012 Whelan ..... B29C 66/1122 428/351
8,122,664 B2 * 2/2012 Ben-Daat ..... B32B 5/18 52/309.8
8,122,666 B2 2/2012 Gupta
8,137,170 B2 3/2012 Klement
8,152,608 B1 4/2012 Hamby
8,176,699 B1 5/2012 Birchfield
8,178,643 B2 * 5/2012 Edstrom ..... C08G 18/482 49/504
8,240,103 B2 * 8/2012 Riepe ..... 52/565
8,245,947 B2 8/2012 Roderick et al.
8,453,404 B2 6/2013 Cox
8,613,180 B2 * 12/2013 Strickland et al. ..... 52/742.13
8,695,299 B2 * 4/2014 Propst ..... 52/309.11
8,745,950 B2 6/2014 Ito et al.
8,793,952 B2 * 8/2014 Olang ..... 52/309.4
8,925,270 B2 1/2015 Grisolia et al.
2002/0020129 A1 2/2002 Winter
2003/0126806 A1 7/2003 Ellis
2003/0150183 A1 8/2003 Egan
2003/0172613 A1 9/2003 Fontana et al.
2004/0000113 A1 1/2004 Alderman
2004/0148889 A1 * 8/2004 Bibee et al. ..... 52/481.1
2005/0055973 A1 * 3/2005 Hagen, Jr. ..... E04B 1/7604 52/741.1
2005/0055982 A1 3/2005 Medina
2005/0072072 A1 4/2005 Duncan et al.
2005/0076600 A1 4/2005 Moody et al.
2005/0144900 A1 7/2005 Hallissy et al.
2005/0163881 A1 7/2005 Pierick et al.
2005/0166496 A1 8/2005 Farag
2005/0188649 A1 * 9/2005 Hagen, Jr. ..... 52/782.1
2005/0204697 A1 9/2005 Rue
2005/0204699 A1 9/2005 Rue
2005/0255318 A1 11/2005 Czerny
2006/0068188 A1 3/2006 Morse et al.
2006/0117689 A1 6/2006 Onken et al.
2006/0185267 A1 8/2006 Tonyan et al.
2006/0201089 A1 9/2006 Duncan et al.
2006/0251851 A1 11/2006 Bowman
2006/0260267 A1 11/2006 Hagen, Jr. et al.
2007/0034110 A1 2/2007 Zupancich et al.
2007/0062151 A1 3/2007 Smith
2007/0234649 A1 10/2007 Near et al.
2007/0234667 A1 10/2007 Lubker, II et al.
2007/0294976 A1 12/2007 Fay
2008/0047217 A1 2/2008 Browning et al.
2008/0071058 A1 3/2008 Rosthauser
2008/0193712 A1 8/2008 Desjardins
2008/0245007 A1 10/2008 Mcdonald
2008/0260993 A1 10/2008 Koester
2008/0295450 A1 12/2008 Yogev
2009/0056255 A1 3/2009 Barton
2009/0100780 A1 4/2009 Mathis et al.
2009/0107065 A1 * 4/2009 LeBlang ..... E04B 1/165 52/252
2009/0239059 A1 9/2009 Kipp et al.
2009/0255201 A1 * 10/2009 Kraus et al. ..... 52/309.5
2009/0308001 A1 12/2009 Wu et al.
2010/0058700 A1 3/2010 LeBlang
2010/0095613 A1 4/2010 Paetkau et al.
2010/0107539 A1 5/2010 Martens et al.
2010/0269439 A1 10/2010 Morrisette
2010/0307089 A1 12/2010 Cox
2011/0024050 A1 2/2011 Booth et al.
2011/0036030 A1 2/2011 Hegland
2011/0047908 A1 * 3/2011 Brusman ..... E04C 2/205 52/220.1
2011/0094175 A1 4/2011 Groft
2011/0107723 A1 5/2011 Hurlburt
2011/0239574 A1 10/2011 Morris et al.
2011/0258944 A1 * 10/2011 Radoane ..... 52/62
2011/0296794 A1 * 12/2011 Thomas ..... B32B 7/14 52/784.11
2011/0314759 A1 12/2011 McCullough
2012/0011792 A1 1/2012 DeWildt et al.
2012/0100289 A1 4/2012 Egan et al.
2012/0151869 A1 6/2012 Miller
2012/0317923 A1 12/2012 Herdt et al.
2013/0019549 A1 1/2013 Henriquez
2013/0067841 A1 3/2013 Grieco et al.
2013/0081346 A1 4/2013 Kulprathipanja et al.

(56) References Cited

U.S. PATENT DOCUMENTS

| | | | |
|---|---|---|---|
| 2013/0209782 | A1 | 8/2013 | Kipp et al. |
| 2014/0033627 | A1 | 2/2014 | Stephens, Jr. et al. |
| 2014/0053486 | A1 | 2/2014 | Grisolia et al. |
| 2014/0115988 | A1 | 5/2014 | Sievers et al. |
| 2014/0115989 | A1 | 5/2014 | Sievers et al. |
| 2014/0115991 | A1 | 5/2014 | Sievers et al. |
| 2014/0174011 | A1 | 6/2014 | Smith |
| 2015/0376898 | A1 | 12/2015 | Kreizinger |

FOREIGN PATENT DOCUMENTS

| | | | |
|---|---|---|---|
| CA | 1284571 | C | 6/1991 |
| CA | 2006652 | A1 | 6/1991 |
| CA | 2097788 | A1 | 12/1993 |
| CA | 2081651 | A1 | 4/1994 |
| CA | 2174573 | A1 | 10/1996 |
| CZ | 302477 | B6 | 6/2011 |
| DE | 1281133 | B | 10/1968 |
| EP | 0004216 | A1 | 9/1979 |
| EP | 0111235 | A2 | 6/1984 |
| EP | 0191709 | A1 | 8/1986 |
| EP | 0553414 | A1 | 8/1993 |
| EP | 2333474 | A2 | 6/2011 |
| ES | 2351467 | A1 | 2/2011 |
| FR | 2421344 | A1 | 10/1979 |
| FR | 2481341 | A1 | 10/1981 |
| FR | 2576943 | A1 | 8/1986 |
| FR | 2955863 | | 8/2011 |
| GB | 1097452 | A | 1/1968 |
| GB | 1196469 | A | 6/1970 |
| GB | 2145756 | A | 4/1985 |
| GB | 2196032 | A | 4/1988 |
| JP | H06185130 | A | 7/1994 |
| NL | 1020177 | C2 | 9/2003 |
| SU | 775258 | A1 | 10/1980 |
| WO | WO 0183911 | A1 | 11/2001 |
| WO | WO 2005103407 | A2 | 11/2005 |
| WO | WO 2006028698 | A1 | 3/2006 |
| WO | WO 2011003143 | A1 | 1/2011 |
| WO | WO 2012027353 | A2 | 3/2012 |
| WO | WO 2012/174408 | A2 | 12/2012 |

OTHER PUBLICATIONS

International Search Report for Application No. PCT/US2012/042751 dated Sep. 13, 2012, 3 pages.
International Search Report for Application No. PCT/US12/42667 dated Sep. 7, 2012, 4 pages.
International Search Report for Application No. PCT/US2012/042718 dated Sep. 17, 2012, 3 pages.
English language abstract for CZ 302477 extracted from espacenet.com database on May 12, 2014, 12 pages.
English language translation for DE 1281133 extracted from espacenet.com database on Apr. 30, 2014, 11 pages.
English language abstract for EP 0004216 extracted from espacenet.com database on May 12, 2014, 19 pages.
English language abstract and translation for EP 0111235 extracted from espacenet.com database on Apr. 30, 2014, 14 pages.
English language abstract and translation for EP 0191709 extracted from espacenet.com database on Apr. 30, 2014, 40 pages.
English language translation for ES 2351467 extracted from espacenet.com database on Apr. 30, 2014, 21 pages.
English language abstract and translation for FR 2421344 extracted from espacenet.com on Apr. 30, 2014, 18 pages.
English language abstract and translation for FR 2481341 extracted from espacenet.com on Apr. 30, 2014, 15 pages.
English language translation for FR 2576943 extracted from espacenet.com database on Apr. 30, 2014, 39 pages.
English language abstract and translation for JP H06185130 extracted from epacenet.com database on May 12, 2014, 11 pages.
English language abstract for NL 1020177 extracted from espacenet.com database on Apr. 30, 2012, 21 pages.
English language translation for SU 775258 extracted from espacenet.com database on Apr. 30, 2014, 8 pages.
Handbook of Adhesives and Sealants; Chapter 8: Adhesive Classifications, pp. 279-317, McGraw Hill New York 2000.
Handbook of Adhesives and Sealants; Chapter 10: Adhesive Families, pp. 343-414, McGraw Hill New York 2000.
Handbook of Adhesives and Sealants; Chapter 12: Sealant Classification and Composition, pp. 451-474, McGraw Hill New York 2000.
Handbook of Adhesives and Sealants; Chapter 13: Sealant Familes, pp. 475-499, McGraw Hill New York 2000.
International Search Report for Application No. PCT/US2016/013880 dated Apr. 6, 2016, 2 pages.
International Search Report for Application No. PCT/US2016/013884 dated Apr. 6, 2016, 2 pages.
Final Office Action from counterpart U.S. Appl. No. 16/523,497 dated Jan. 11, 2021.
Office Action from counterpart U.S. Appl. No. 16/523,497 dated Aug. 11, 2020.
Office Action from counterpart Canadian Patent Appln. No. 2,839,587 dated Mar. 15, 2019.

* cited by examiner

HIGH PERFORMANCE WALL ASSEMBLY

CROSS REFERENCE TO RELATED APPLICATION

This application is the National Stage of International Patent Application No. PCT/US2012/042667, filed on Jun. 15, 2012, which claims priority to and all the advantages of U.S. Patent Application No. 61/498,090 filed on Jun. 17, 2011, which is incorporated by reference.

BACKGROUND OF THE INVENTION

1. Field of the Invention

The invention generally relates to a high performance wall assembly. More specifically, the invention relates to a high performance wall assembly having a structural foam layer.

2. Description of the Related Art

Wall assemblies for use as walls of a building, such as residential buildings, or commercial buildings, are known in the art. A conventional wall includes a frame assembly. The frame assembly includes a top member, a bottom member spaced from the top member, and a plurality of vertical members disposed between the top and bottom members. Typically, the top, bottom, and vertical members of the frame assembly comprise wood. The top, bottom, and vertical members of the frame assembly are coupled together using fasteners, such as nails or screws.

The conventional wall assembly also includes an insulating layer coupled to the frame assembly. Typically, the insulating layer comprises preformed panels made from polystyrene. The insulating layer is coupled to the frame assembly by using the fasteners. The use of the fasteners to couple together the vertical members, the top member and the bottom member and to couple together the insulating layer and the frame member increases a cost to manufacture the conventional wall assembly. The use of fasteners also increase a manufacturing time to construct the conventional wall assembly. Therefore, there remains a need to provide an improved high performance wall assembly.

SUMMARY OF THE INVENTION AND ADVANTAGES

A high performance wall assembly receives an exterior covering of a building. The high performance wall assembly includes a frame assembly. The frame assembly has a top member, a bottom member opposite said top member, and a plurality of vertical members. The vertical members are couple to and extend between the top and bottom members. The frame assembly has an interior side and an exterior side opposite the interior side. The high performance wall assembly also includes a rigid foam insulating panel coupled to the frame assembly and extending from the exterior side of the frame assembly. The rigid foam insulating panel terminates at an exterior surface of the rigid foam insulating panel. The exterior surface of the rigid foam insulating panel is configured to receive the exterior covering of the building.

The high performance wall assembly further includes a structural foam layer disposed on the plurality of vertical members and on the rigid foam insulating panel. The structural foam layer couples the rigid foam insulating panel to the frame assembly. The structural foam layer also couples the plurality of vertical members to the top and bottom members such that the high performance wall is free of fasteners. Eliminating the need for fasteners allows the high performance wall assembly to be constructed fasted and at a reduced cost as compared to conventional wall assemblies.

Additionally, methods of manufacturing the high performance wall assembly are disclosed.

BRIEF DESCRIPTION OF THE DRAWINGS

Other advantages of the present invention will be readily appreciated, as the same becomes better understood by reference to the following detailed description, when considered in connection with the accompanying drawings wherein.

DETAILED DESCRIPTION OF THE EXEMPLARY EMBODIMENT

Figure 1:
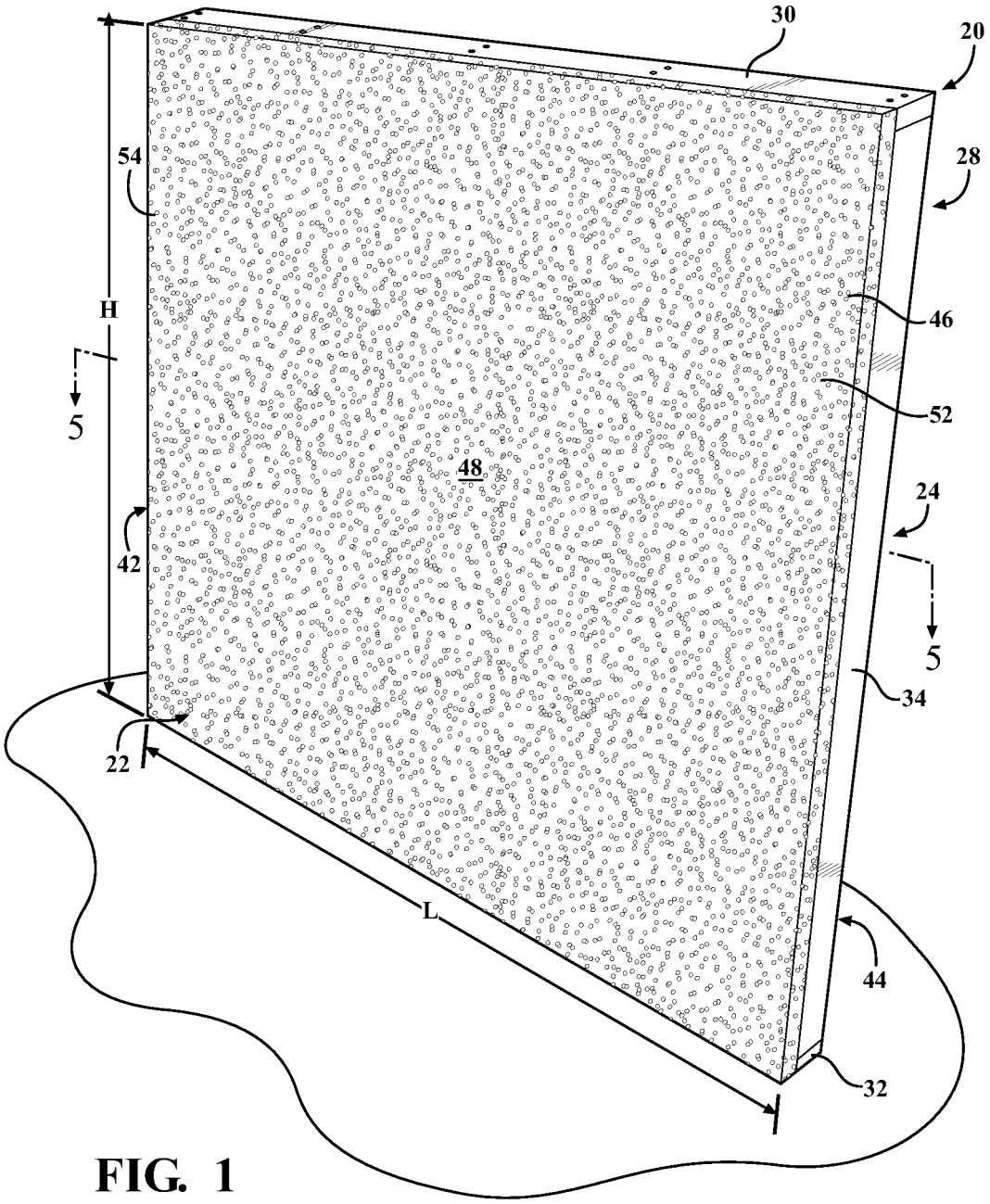
FIG. 1 is a perspective view of an exterior face of a high performance wall assembly having a frame assembly and an rigid foam insulating panel.

Referring to the Figures, wherein like numerals indicate corresponding parts throughout the several views, a high performance wall assembly is generally shown at 20. The high performance wall assembly 20 is for constructing a building, such as a residential building or a commercial building. For example, the high performance wall assembly 20 is at least one of a plurality of exterior walls of the building. It is to be appreciated that the high performance wall assembly 20 may only be one of the plurality of exterior walls of the building or the high performance wall assembly 20 may be all of the plurality of exterior walls of the building. Said differently, the high performance wall assembly 20 may be used to construct a single exterior wall of the building.

Alternatively, multiple high performance wall assemblies may be used to construct the exterior walls of building. Said differently, the high performance wall assembly 20 may be coupled to another high performance wall assembly 20 to define a perimeter of the building. Additionally, the high performance wall assembly 20 may be coupled to a traditional field constructed wall to define the perimeter of the building. It is to be appreciated that the high performance wall assembly 20 may be coupled to the traditional field constructed wall or the another high performance wall assembly 20 by any suitable methods. For example, fasteners, such as nails or screws, an adhesive bead, or straps could be used to the couple together the adjacent high performance wall assemblies 20.

Generally, the high performance wall assembly 20 has an exterior face 22, which faces an exterior of the building when the high performance wall assembly 20 is the wall of the building. Additionally, the high performance wall assembly 20 has an interior face 24, which faces an interior of the building when the high performance wall assembly 20 is the wall of the building. The high performance wall assembly 20 can be manufactured in any length L or height H desired for use as the exterior walls of the building. Additionally, the high performance wall assembly 20 may be used completely above grade or extend below grade such that a portion of the high performance wall assembly 20 is embedded within the ground. Furthermore, the high performance wall assembly 20 can be used as interior walls of the building.

It is to be appreciated that the high performance wall assembly 20 may be manufactured off-site from the location of the building. Said differently, the high performance wall assembly 20 may be manufactured at a location that is different from the location that the building is to be constructed. For example, the high performance wall assembly 20 can be manufactured at a factory or a warehouse and subsequently transported to the location that the building is to be constructed. Manufacturing the high performance wall assembly 20 off-site decreases labor cost for constructing the building and decreases construction time required to construct the building once the high performance wall assembly 20 is on-site.

Once the high performance wall assembly 20 is delivered on-site, the high performance wall assembly 20 is secured in position on a support structure of the building, such as a footer, foundation wall, or another high performance wall assembly 20. It is to be appreciated that the high performance wall assembly 20 may be positioned with the assistance of machinery, such as a crane. Alternatively, the high performance wall assembly 20 may be manufactured on-site at the location where the building is to be constructed. However, it is to be appreciated that the high performance wall assembly 20 may receive the exterior covering 26 prior to arriving on-site, i.e., in the factor or the warehouse.

Typically, once the high performance wall assembly 20 is secured in position, the high performance wall assembly 20 receives an exterior covering 26 of the building, such as siding, brick, and/or an insulating foam panel. The exterior covering 26 may be secured to the high performance wall assembly 20 by exterior fasteners 27, such as nails, screws, or ties. For example, when the exterior covering 26 is brick, the high performance wall assembly 20 may include brick ties as the exterior fasteners 27. Alternatively, the exterior covering 26 may be secured to the high performance wall assembly 20 by an adhesive. For example, when the exterior covering 26 is siding, panels of the siding may be adhesively bonded to the high performance wall assembly 20.

Figure 2:
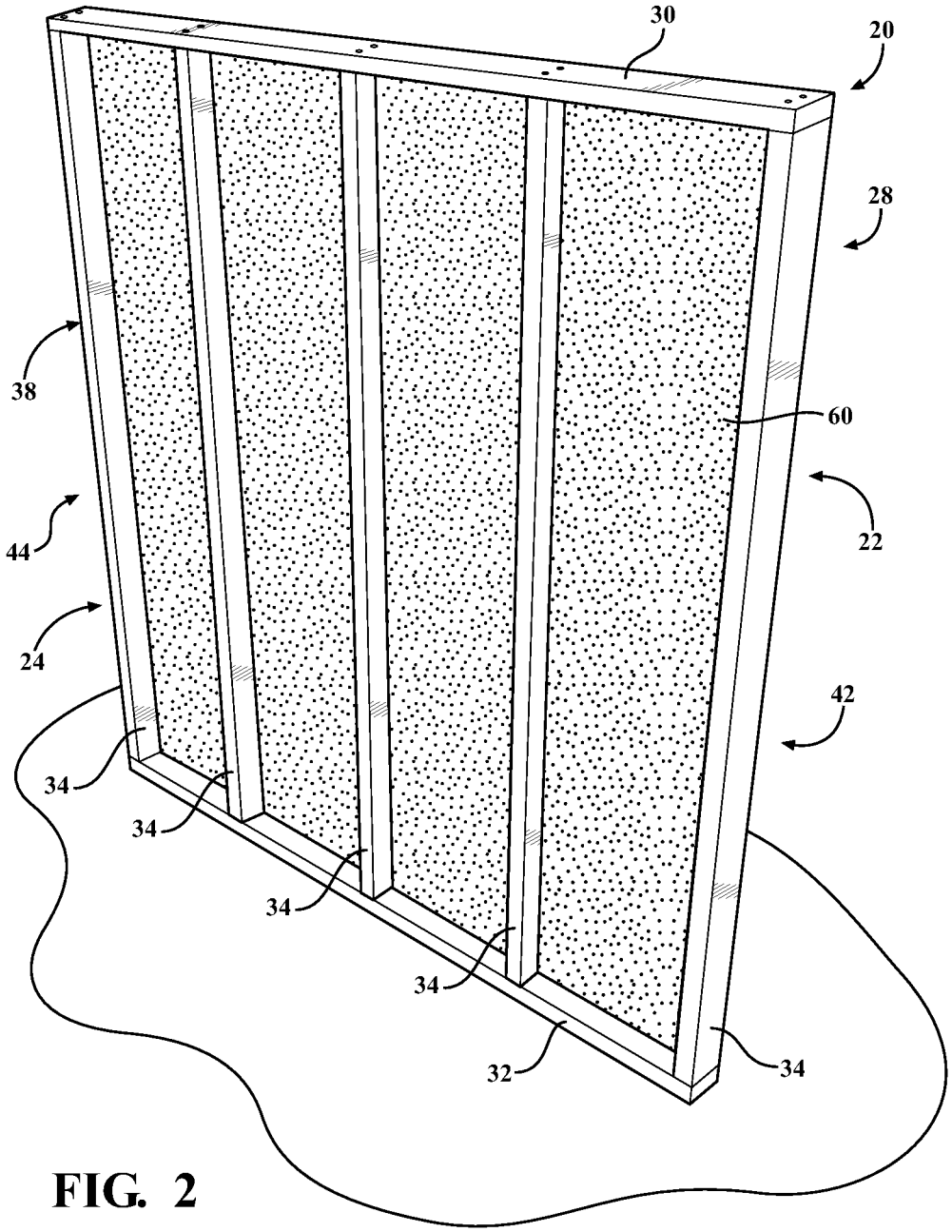
FIG. 2 is a perspective view of an interior face of the high performance wall assembly having a frame assembly and an rigid foam insulating panel.
Figure 3:
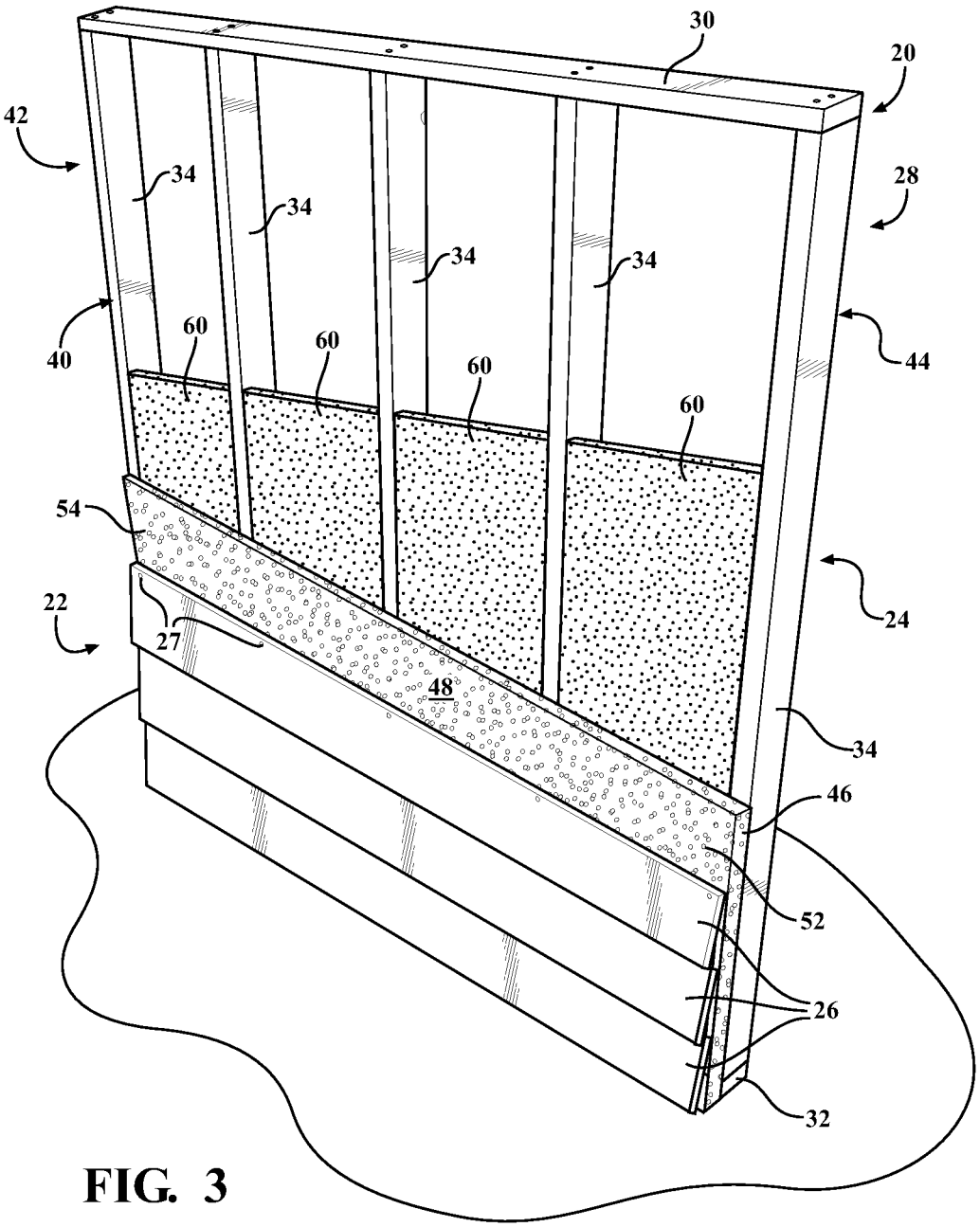
FIG. 3 is a partial cutaway perspective view of the exterior face of the high performance wall assembly having an exterior covering coupled to the frame assembly.

With reference to FIGS. 1-3, the high performance wall assembly 20 comprises a frame assembly 28. The frame assembly 28 includes a top member 30 and a bottom member 32 spaced from the top member 30. The frame assembly 28 also includes a plurality of vertical members 34 coupled to and extending between the top and bottom members 30, 32. Although not required, the top, bottom, and vertical members 30, 32, 34 may be coupled together using fasteners 36, such as nails and/or screws. Generally, the top and bottom members 30, 32 are horizontal and the vertical members 34 are perpendicular to the top and bottom members 30, 32. However, it is to be appreciated that the top and bottom members 30, 32 may be vertical with the vertical members 34 extending horizontally between the top and bottom members 30, 32.

The top, bottom, and vertical members 30, 32, 34 of the frame assembly 28 present an interior side 38 of the frame assembly 28 and an exterior side 40 of the frame assembly 28 opposite the interior side 38. Generally, when the high performance wall assembly 20 is secured in position on the support structure of the building, the interior side 38 of the frame assembly 28 faces an interior of the building and the exterior side 40 of the frame assembly 28 faces an exterior of the building. Typically, the bottom member 32 is secured in position on the support structure of the building.

Typically, the top, bottom, and vertical members 30, 32, 34 comprise wood. However, it is to be appreciated that the top, bottom, and vertical members 30, 32, 34 may comprise any suitable material, such as fiberglass, aluminum, or other metals. The top, bottom, and vertical members 30, 32, 34 may be of any desired dimensions. For example, the top, bottom, and vertical members 30, 32, 34 may have a nominal cross-section of 2 inches by 4 inches or a nominal cross-section of 2 inches by 6 inches. It is to be appreciated that the top, bottom, and vertical members 30, 32, 34 may be of different dimensions relative to each other. For example, the top and bottom members 30, 32 may have the nominal cross-section of 2 inches by 6 inches and the vertical members 34 may have the nominal cross-section of 2 inches by 4 inches.

Figure 5:
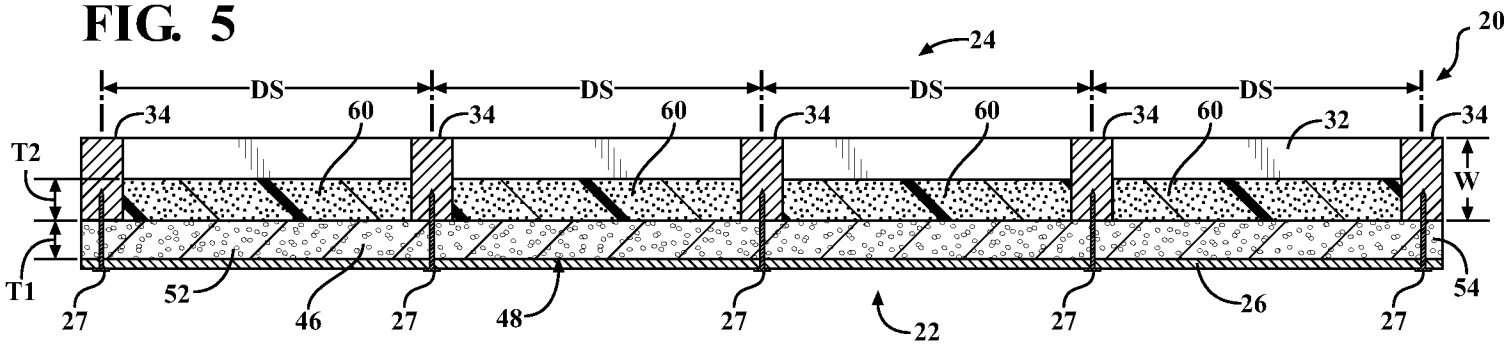
FIG. 5 is a cross-sectional view of the high performance wall assembly taken along line 5-5 of FIG. 1.
Figure 6:
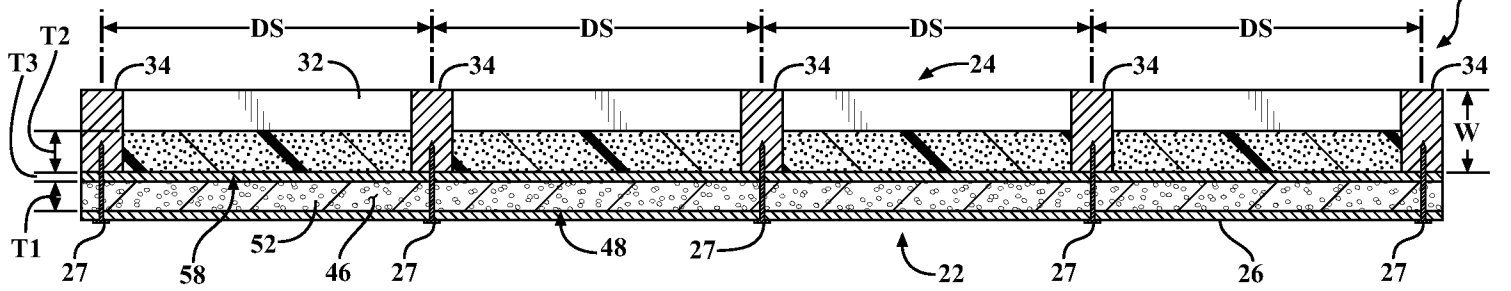
FIG. 6 is a cross-sectional view of the high performance wall assembly taken along line 6-6 of FIG. 4.

As best illustrated in FIG. 1, the vertical members 34 along with the top and bottom members 30, 32 define the height H of the high performance wall assembly 20. Typically, the height H of the high performance wall assembly 20 is of from about 2 to about 24, more typically of from about 6 to about 12, and even more typically of from about 8 to about 12 feet. With reference to FIGS. 5 and 6, a nominal width W of the frame assembly 28 is defined by a width of the top, bottom, and vertical members 30, 32, 34. Typically, the nominal width W of the frame assembly 28 is of from about 1 to about 8, more typically of from about 2 to about 8, and even more typically of from about 4 to about 6 inches.

With reference to FIGS. 1 and 2, the frame assembly 28 has a first end 42 and a second end 44 spaced from the first end 42. Typically, one of the vertical members 34 is disposed at the first end 42 of the frame assembly 28 and another one of the vertical members 34 is disposed at the second end 44 of the frame assembly 28 with other vertical members 34 equally spaced between the first and second ends 42, 44 of the frame assembly 28. The length L of the high performance wall assembly 20 is defined between the first and second ends 42, 44 of the frame assembly 28. Additionally, the top and bottom members 30, 32 are generally equal to the length L of the high performance wall assembly 20. Typically, the length L of the high performance wall assembly 20 is of from about 1 to about 52, more typically of from about 5 to about 25, and even more typically of from about 12 to about 16 feet.

Figure 7:
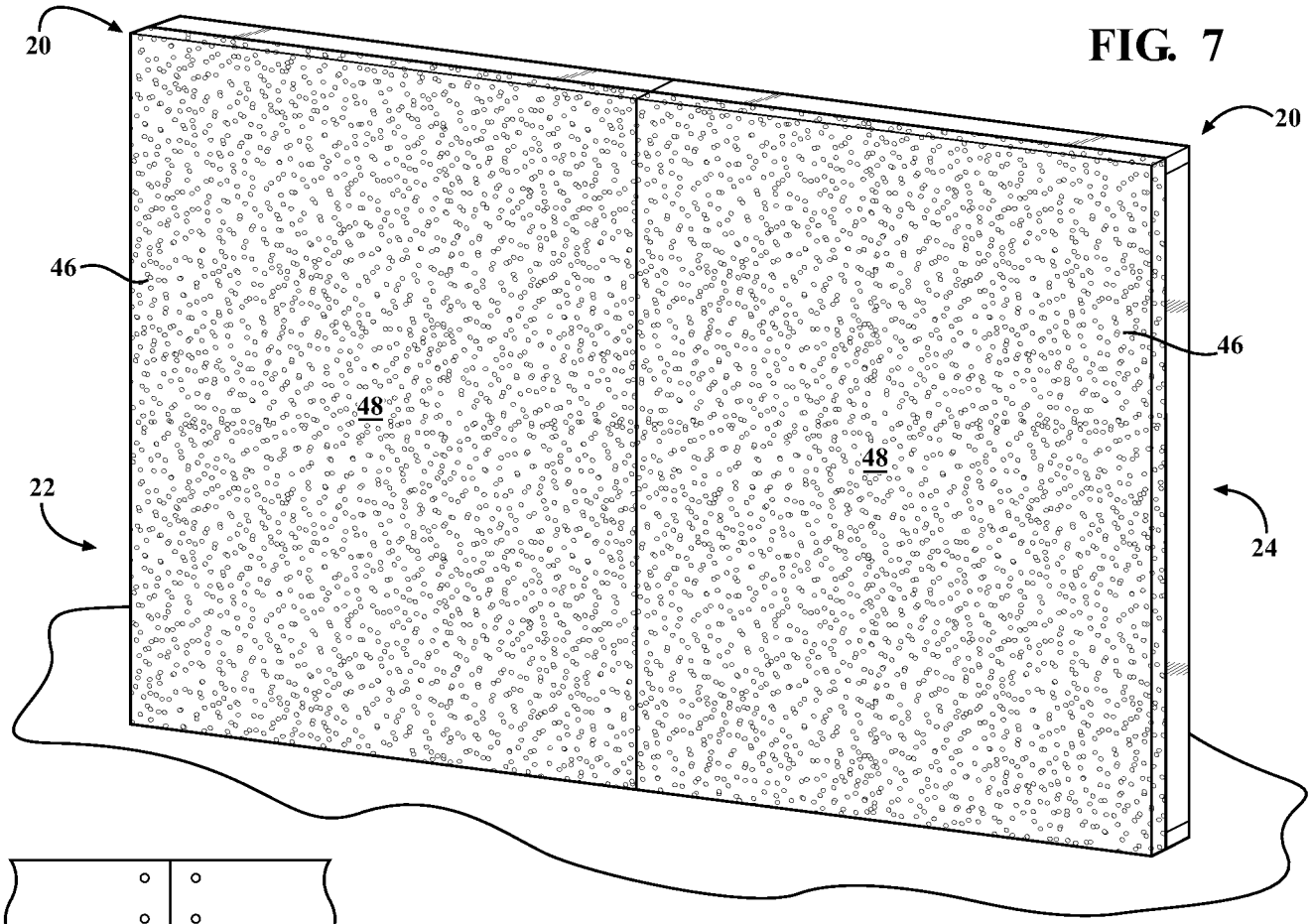
FIG. 7 is a perspective view of the exterior face of two prefabricated wall assemblies joined together.
Figure 8:
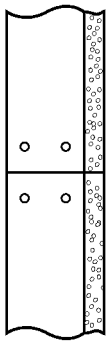
FIG. 8 is a top view of a portion of the prefabricated wall assemblies of FIG. 8.

The length L of the high performance wall assembly 20 may vary depending on specific needs of a customer. For example, the length L of the high performance wall assembly 20 may be equal to a length of the exterior wall of the building in which the high performance wall assembly 20 is to be used. Alternatively, the length L of the high performance wall assembly 20 may be shorter than the exterior wall of the building in which the high performance wall assembly 20 is to be used such that multiple prefabricated wall assemblies are joined together, as shown in FIGS. 7 and 8, to form a unitary wall of the building.

Figure 9:
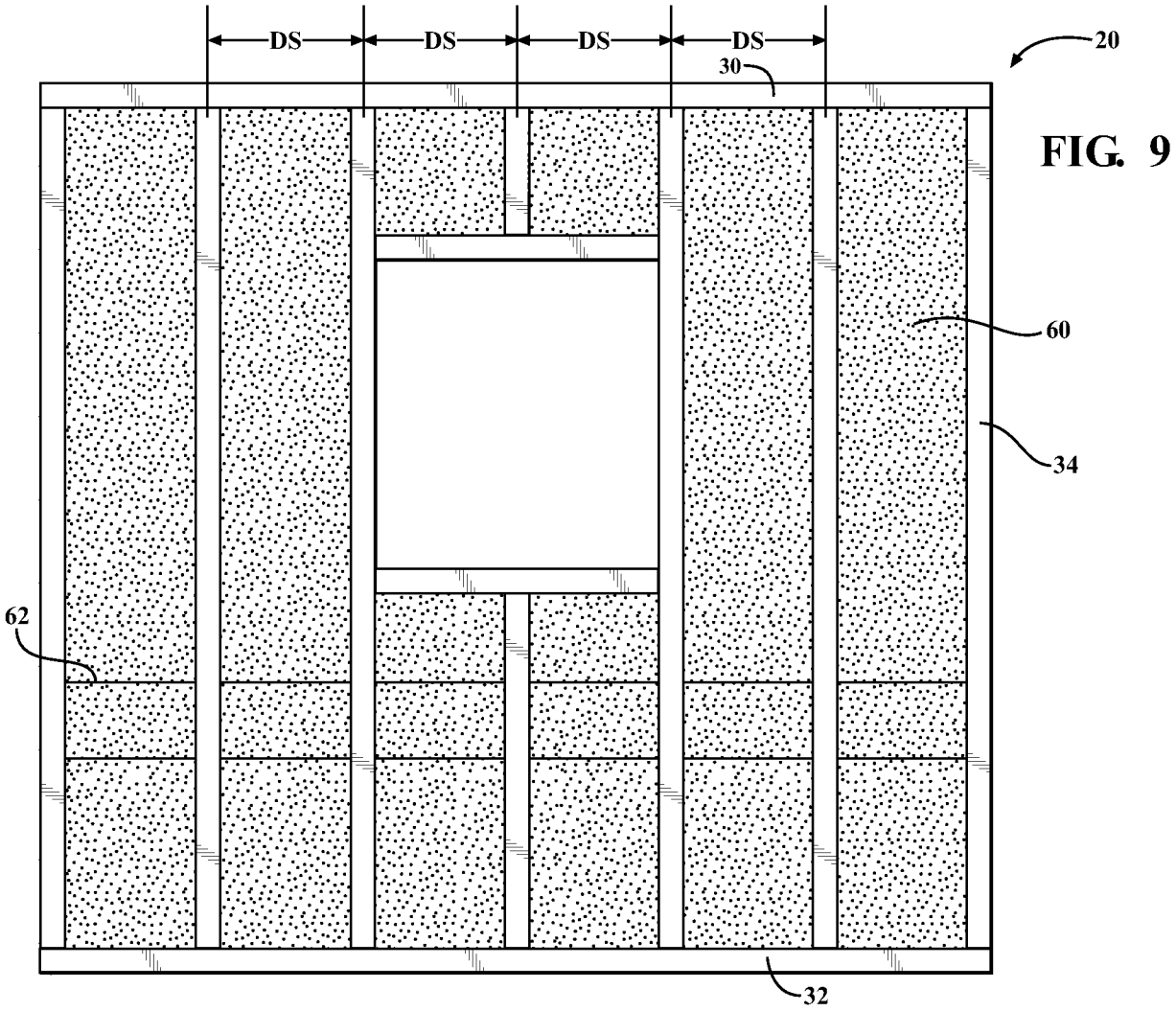
FIG. 9 is a view of the interior face of high performance wall assembly having an opening for receiving a window frame.

With reference to FIGS. 5 and 6, the vertical members 34 are typically spaced apart from each other a distance DS. A plurality of voids are defined between the vertical members 34. Said differently, the plurality of voids are between the vertical members 34. Typically, the distance DS is measured from a centerline of one of the vertical members 34 to a centerline of another one of the vertical members 34. As alluded to above, the vertical members 34 are typically equally spaced apart throughout the frame assembly 28. However, it is to be appreciated that the distance DS between adjacent vertical members 34 may vary throughout the frame assembly 28. For example, as shown in FIG. 9, the distance DS between the vertical members 34 may vary for defining an opening in the frame assembly 28 to receive a window frame. It is to be appreciated that the distance DS between the vertical members 34 may vary for defining other openings in the frame assembly 28 to receive other desired structures, such as door frames. The distance DS between adjacent vertical members 34 is typically of from about 1 to about 30, more typically of from about 10 to about 30 even more typically of from about 12 to about 28 inches.

With reference to FIGS. 1-3, the high performance wall assembly 20 comprises a rigid foam insulating panel 46 coupled to the frame assembly 28. The rigid foam insulating panel 46 can be a preformed panel. The rigid foam insulating panel 46 is generally planar. Said differently, an exterior surface 48 of the rigid foam insulating panel 46 is generally parallel to the exterior side 40 of the frame assembly 28. The rigid foam insulating panel 46 extends from the exterior side 40 of the frame assembly 28 to the exterior surface 48 of the rigid foam insulating panel 46. The exterior surface 48 of the rigid foam insulating panel 46 is configured to receive the exterior covering 26 of the building. The rigid foam insulating panel 46 spaces the exterior covering 26 from the exterior side 40 of the frame assembly 28.

Generally, the rigid foam insulating panel 46 impedes the infiltration of water vapor into the frame assembly 28 thereby preventing infiltration of the water vapor into the building. Additionally, the rigid foam insulating panel 46 may prevent air from infiltrating the high performance wall assembly 20, which maintains the thermal resistance of the high performance wall assembly 20. For example, the rigid foam insulating panel 46 may be a vapor retarder and an air barrier. Generally, the rigid foam insulating panel 46 meets ASTM E2357, which is related to the determination of air leakage.

The rigid foam insulating panel 46 comprises a plurality of particles 52 and a binder. Typically, the particles 52 comprise greater than 80, more typically greater than 85, and even more typically greater than 90 percent by volume of the rigid foam insulating panel 46. The particles 52 have a density typically of from about 1000 $kg/m_3$ or less, more typically of from about 500 $kg/m_3$ or less, and even more typically less than 300 $kg/m_3$.

Typically, the binder is a polymer. However, it is to be appreciated that the binder may be any suitable material for binding the particles 52 together. Typically, the polymer is selected from the group of acrylic-based polymers or copolymers, styrene-acrylic-based copolymers, styrenebutadiene-based copolymers, vinyl acrylic-based copolymers, vinyl acetate based polymers or copolymers, polyvinylidene chloride, neoprene, natural rubber latex, and combinations thereof. The binder may include a self-crosslinking polymer or a crosslinkable polymer. Generally, the rigid foam insulating panel 46 is substantially free of curing agents or crosslinking agents. However, the binder may further include a crosslinking agent, such as a metal salt of an organic acid. Additionally, the binder may include a curing agent.

The particles 52, as described herein, can be pre-expanded polymers that can be fully expanded or partially expanded, for example, with air. For example, the pre-expanded polymer can comprise of from 50 to 90 percent air by volume. The pre-expanded polymer can be selected from the group of polystyrene, styrene based-copolymers, polyethylene, polypropylene, polyesters, polyvinylchloride, cellulose acetate, and combinations thereof. The pre-expanded polymer can include poly(styrene-co-acrylonitrile). The particles 52 can include beads, flakes, granules, fibers, platelets, spheres, microballoons, and combinations thereof. The plurality of particles 52 can be flame retardant. The plurality of particles 52 can further include recycled material. The average particle size of the largest dimension of the particles 52 is typically of from about 0.1 to about 10 mm.

The rigid foam insulating panel 46 may include a filler, such as heat reflective material, fire retardants, and impact modifiers. Examples of suitable heat reflective material include, but are not limited to, graphite, and pigments. The rigid foam insulating panel 46 meets ASTM C578 for the Standard Specification for Rigid, Cellular Polystyrene Thermal Insulation. Examples of suitable foams for use as the rigid foam insulating panel 46 are commercially available from the BASF Corporation under the trade name(s) Neopor, Styropor, Comfort Foam, Walltite, Spraytite, Autofroth, Elastopor, and Enertite.

The rigid foam insulating panel 46 has a thickness T1 of from about 0.5 to about 12, more typically of from about 1 to about 8, and even more typically or from about 1 to about 3 inches. Additionally, the rigid foam insulating panel 46 has a density of from about 0.50 to about 5.00, more typically of from about 0.75 to about 4.00, and even more typically of from about 1.00 to about 3.00 pounds per cubic foot. Furthermore, the rigid foam insulating panel 46 has an R-value of from about 3.5 to about 7.0, more typically of from about 3.5 to about 6.5, and even more typically of from about 4.0 to about 6.0 per inch.

With reference to FIGS. 2-5, the high performance wall assembly 20 includes a structural foam layer 60 disposed on the vertical members 34 of the frame assembly 28 and on the rigid foam insulating panel 46. Generally, the structural foam layer 60 is disposed between the vertical members 30. The structural foam layer 60 may be in contact with the vertical members 30 or, alternatively, the structural foam layer 60 may be spaced from the vertical members 30 while still being disposed between the vertical members 30.

The structural foam layer 60 couples the rigid foam insulating panel 46 to the frame assembly 28 such that the rigid foam insulating layer 46 is free of fasteners. Said differently, the structural foam layer 60 adheres the rigid foam insulating panel 46 to the frame assembly 28 without the use of fasteners. Said yet another way, fasteners are not needed to couple the rigid foam insulating layer 46 to the frame assembly 28 because the structural foam layer 60 coupled the rigid foam insulating panel 46 to the frame assembly 28. Although not required, it is to be appreciated that the rigid foam insulating panels 46 may be coupled to the frame assembly 28 by fasteners. However, the use of the structural foam layer 60 reduces the number of fasteners or completely eliminates the use of fasteners needed for coupling the rigid foam insulating panel 46 to the frame assembly 28 thereby reducing a manufacturing cost of the high performance wall assembly. Generally, the structural foam layer 60 provides structural support to the frame assembly 28. Said differently, the structural foam layer 60 may couple the top, bottom, and vertical members 30, 32, 34 together thereby reducing the number of fasteners needed to structurally secure the top, bottom, and vertical members 30, 32, 34 together. Furthermore, the structural foam layer 60 may completely eliminate the need for fasteners to couple together the top, bottom, and vertical members 30, 32, 34 such that the frame assembly 28 is free of fasteners while still meeting structural requirements.

The structural foam layer 60 has a cohesive strength suitable for coupling the rigid foam insulating layer 46 to the frame assembly 28. Typically, the cohesive strength of the structural foam layer 60 is of from about 5.0 to about 50, more typically, of from about 10 to about 40, and even more typically of from about 12 to about 35 pounds per square foot. Typically, the structural foam layer 60 comprises a foam selected from the group of polyurethane foams, polyurea foams, and combinations thereof. More typically, the structural foam layer 60 comprises a sprayable foam selected from the group of polyurethane foams, polyurea foams, and combinations thereof. Said differently, the structural foam layer 60 may be spray applied to the frame assembly 28 and the rigid foam insulating panel 46. When the sprayable foam is a polyurethane sprayable foam, the sprayable foam may be the reaction product of a polyether polyol and an isocyanate. It is to be appreciated that any polyether polyols may be used. Alternatively, when the sprayable foam is the polyurethane sprayable foam, the sprayable foam may be the reaction product of a polyester polyol and the isocyanate. The use of the polyester polyol imparts the rigid foam insulating panel 46 with a fire retardant. When the sprayable foam is a polyurea sprayable foam, the sprayable foam is the reaction product of a polyamine and an isocyanate. An example of a suitable isocyanate for the sprayable foam is lubrinate.

Typically, the structural foam layer 60 has a thickness T2 of from about 0.25 to the width W of the frame assembly 28, more typically of from about 0.50 to about 4.0, and even more typically or from about 1.0 to about 3.0 inches. Additionally, the structural foam layer 60 has a density of from about 0.5 to about 5.0, more typically of from about 1.0 to about 4.0, and even more typically of from about 1.5 to about 4.0 pounds per cubic foot. Furthermore, the structural foam layer 60 has an R-value per inch of thickness of from about 3 to about 9, more typically of from about 4 to about 8, and even more typically of from about 5 to about 7.

The frame assembly 28 may also include an intermediate substrate 56 disposed between the rigid foam insulating panel 46 and the structural foam layer 60 for providing a sheer strength to the high performance wall assembly 20. The intermediate substrate 56 provides the high performance wall assembly 20 with the sheer strength to resist axial loads, shear loads, and lateral loads applied to the high performance wall assembly 20. For example, the frame assembly 28 may include wind bracing, hurricane straps, and/or up-lifting clips. Typically, the intermediate substrate 56 is a sheet of rigid material, such as plywood or oriented strand board (OSB). When the intermediate substrate 56 is a sheet of rigid material, the intermediate substrate 56 has a thickness T3 typically of from about 0.125 to about 1.00, more typically of from about 0.25 to about 0.75, and even more typically of from about 0.375 to about 0.344 inches.

Figure 4:
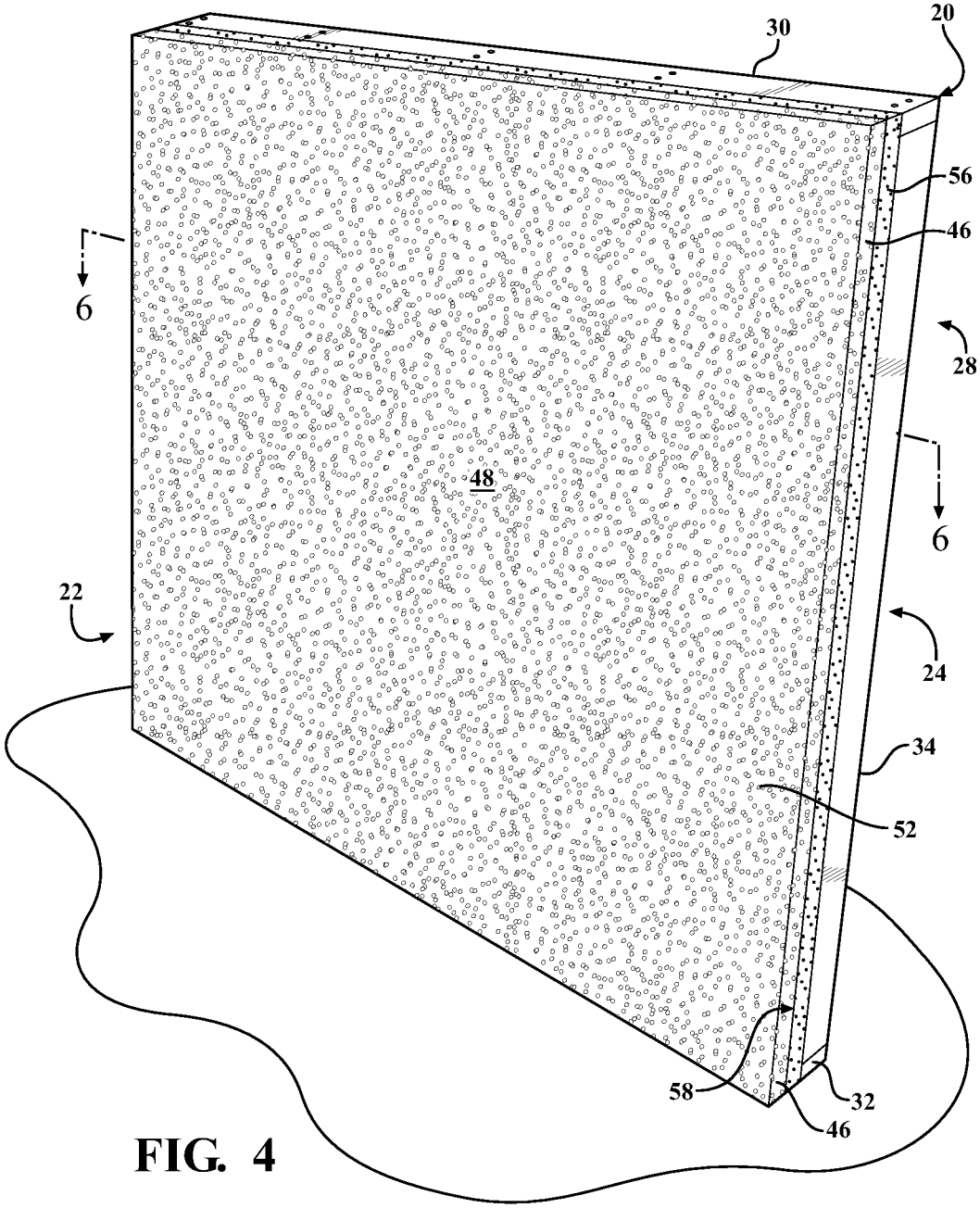
FIG. 4 is a perspective view of an exterior face of the high performance wall assembly with the rigid foam insulating panel coupled to an intermediate substrate.
Figure 4A:
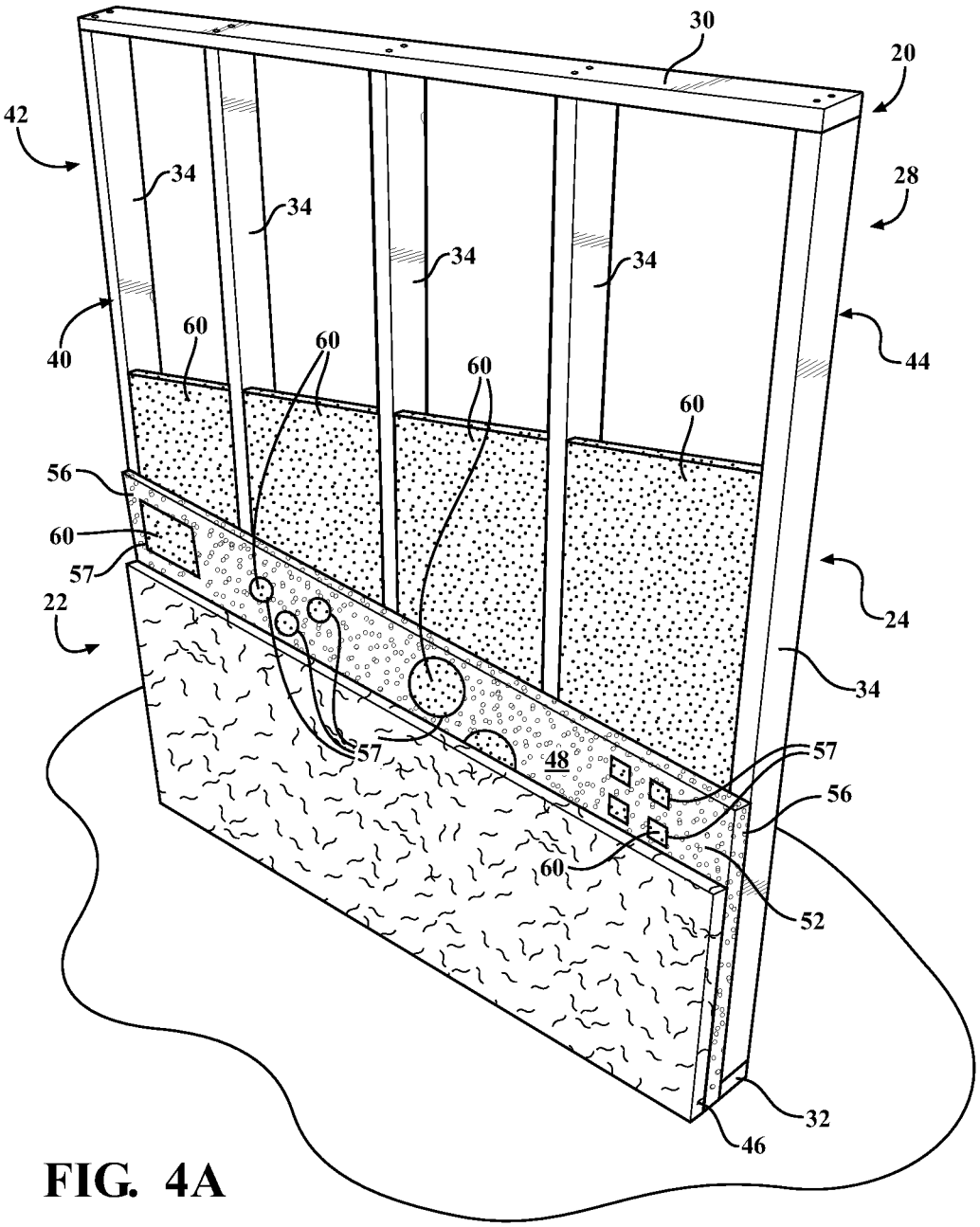
FIG. 4A is a partial cutaway perspective view of the high performance wall assembly of FIG. 4.

With reference to FIG. 4A, the intermediate substrate 56 may define a plurality of holes 57 with the structural foam layer 60 disposed through the holes 57 to contact the rigid foam insulating panel. Allowing the structural foam layer 60 to be disposed on and pass through the intermediate substrate 56 results in the structural foam layer 60 to couple both the rigid foam layer 46 and the intermediate substrate 56 to the frame assembly 28.

Generally, the rigid foam insulating panel 46 and the structural foam layer 60 provide the high performance wall assembly 20 with the thermal resistance. Said differently, the rigid foam insulating panel 46 and the structural foam layer 60 insulate the high performance wall assembly 20. The thickness T1 of the rigid foam insulating panel 46 and the thickness T2 of the structural foam layer 60 may be varied to adjust the thermal resistance of the high performance wall assembly 20. Generally, a desired thermal resistance varies depending on the climate of the location where the building is to be constructed. As such, the thickness T1 of the rigid foam insulating panel 46 and the thickness T2 of the structural foam layer 60 may be adjusted to provide the high performance wall assembly 20 with the desired thermal resistance. Typically, the thermal resistance of the high performance wall assembly 20 has an R-value of from about 10 to about 53, more typically of from about 10 to about 30, and even more typically of from about 12 to about 28 units.

The high performance wall assembly 20 may comprise a bather layer coupled to the exterior surface 48 of the rigid foam insulating layer 46. The barrier layer may be an additional vapor retarder, and/or a radiant barrier. For example, the barrier layer may be a sprayable vapor retarder such as acrylic-latex. Typically, the sprayable vapor retarder is applied to the exterior surface 48 of the rigid foam insulating panel 46.

A method of manufacturing the high performance wall assembly 20 includes the step of providing the frame assembly 28. It is to be appreciated that the step of providing the frame assembly 28 may be further defined as assembling the frame assembly 28. It is also to be appreciated that the step of assembling the frame assembly 28 may be further defined as arranging the top member 30, the bottom member 32, and the vertical members 34 to present the frame assembly 28.

The rigid foam insulating panel 46 is positioned adjacent the frame assembly 28. It is to be appreciated that the rigid foam insulating panel 46 may be placed flat on the ground and the frame member placed onto on the rigid foam insulating panel 46. Additionally, the top member 30, the bottom member 32, and the vertical members 34 may be arranged on top of the rigid foam insulating panel 46. This step is particularly helpful when the structural foam layer 60 is to couple the frame member 28 together and couple the rigid foam insulating panel 46 to the frame member 28.

The structural foam layer 60 is applied to the frame assembly 28 and the rigid foam insulating panel 46. More specifically, the step of applying the structural foam layer 60 may be further defined as spraying the structural foam layer 60 onto the vertical members 34, the top member 30, and the bottom member 32 of the frame assembly 28.

As indicated above, the structural foam layer 60 may be spray applied to the frame assembly 28 and the rigid foam insulating layer 46. The structural foam layer 60 is cured to couple the frame assembly 28 together and/or to couple the rigid foam insulating panel 46 to the frame assembly 28 to form the high performance wall assembly 20 such that the high performance wall assembly is free of fasteners. It is to be appreciated that the step of curing the binder may be passive, i.e., there is no need for an affirmative step, such as heating, etc. to cure the binder. Said differently, the binder may cure naturally via a respective curing mechanism of the binder composition. Alternatively, an affirmative step, such as applying heat to the binder, may be required to cure the binder.

When the intermediate substrate 56 is present, the intermediate substrate 56 is positioned between the rigid foam insulating panel 46 and the structural foam layer 60. Additionally, when the intermediate substrate 56 is present, the step of applying the structural foam layer 60 may be further defined as spraying the structural foam layer 60 onto the frame assembly 28 and through the holes 57 of the intermediate substrate 56 to contact the rigid foam insulating panel 46. It is to be appreciated that the rigid foam insulating panel 46 and/or the intermediate substrate 56 may be coupled to the frame assembly 28 either on-site where the building is to be constructed or off-site at a factory or warehouse.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wall assembly comprising:

a frame assembly having a top member, a bottom member opposite said top member, and a plurality of vertical members coupled to and extending between said top and bottom members with said frame assembly having an interior side and an exterior side opposite said interior side, wherein said top member, said bottom member, and said vertical members are made of wood;

a rigid foam insulating panel coupled to said exterior side of said frame assembly and contacting said plurality of vertical members and extending from said exterior side of said frame assembly and terminating at an exterior surface of said rigid foam insulating panel;

a structural foam layer disposed between and adhered to said plurality of vertical members and adhered to an interior surface of said rigid foam insulating panel between said plurality of vertical members such that said plurality of vertical members are not encapsulated in said structural foam layer;

wherein said rigid foam insulating panel comprising a plurality of pre-expanded polymeric beads having multiple bead sizes and a binder, wherein said pre-expanded polymeric beads are selected from the group of polystyrene, styrene based-copolymers, polyethylene, polypropylene, polyesters, polyvinylchloride, cellulose acetate, and combinations thereof, wherein said binder is a polymer selected from the group of acrylic-based polymers or copolymers, styrene-acrylic-based copolymers, styrenebutadiene-based copolymers, vinyl acrylic-based copolymers, vinyl acetate based polymers or copolymers, polyvinylidene chloride, neoprene, natural rubber latex, and combinations thereof for binding the particles together, wherein said rigid foam insulating panel has a thickness of from about 0.5 to about 12 inches and a density of from about 0.5 to about 5.00 pounds per cubic foot;

wherein said frame assembly has a first end and a second end spaced from said first end defining a length of the wall assembly;

an exterior covering disposed directly adjacent said exterior surface of said outer foam layer, said exterior covering being at least one of a siding panel, brick, and insulating foam panel; and wherein said structural foam layer adheres said rigid foam insulating panel to said frame assembly such that said rigid foam insulating panel is free of fasteners.

2. A high performance wall assembly as set forth in claim 1 further comprising an intermediate substrate disposed between said rigid foam insulating panel and said structural foam layer for providing a sheer strength to said high performance wall assembly.

3. A high performance wall assembly as set forth in claim 1 wherein said rigid foam insulating panel is a preformed panel.

4. A high performance wall assembly as set forth in claim 1 wherein a distance between said plurality of vertical members is of from about 1.0 to about 30.0 inches.

5. A high performance wall assembly as set forth in claim 1 further comprising a moisture barrier coupled to said exterior surface of said rigid foam insulating panel.

6. A high performance wall as set forth in claim 1 wherein said structural foam layer couples said plurality of vertical members to said top and bottom members such that said frame assembly is free of fasteners.

7. A method of manufacturing a high performance wall assembly as set forth in claim 1, said method comprising the steps of:

providing the exterior covering;

providing the frame assembly;

positioning the rigid foam insulating panel, said rigid foam insulating panel being adjacent an exterior side of the frame assembly and contacting the plurality of vertical members;

applying the structural foam layer to the frame assembly;

curing the structural foam layer to couple the frame assembly together and to couple the rigid foam insulating panel to the frame assembly to form the high performance wall assembly such that the high performance wall assembly is free of fasteners.

8. A method as set forth in claim 7 wherein the high performance wall assembly further comprises an intermediate substrate defining a plurality of hole and said method further comprises the step of positioning the intermediate substrate between the rigid foam insulating panel and the structural foam layer and contacting the plurality of vertical members and the rigid foam insulating panel.

9. A method as set forth in claim 8 wherein said step of applying the structural foam layer is further defined as spraying the structural foam layer onto the frame assembly and through the holes of the intermediate substrate to contact the rigid foam insulating panel.

10. A method as set forth in claim 7 wherein the step of positioning the rigid foam insulating panel adjacent the frame assembly is further defined as laying a plurality of vertical members, a top member, and a bottom member of the frame assembly on the rigid foam insulating panel.

11. A method as set forth in claim 10 wherein the step of applying the structural foam layer is further defined as spraying the structural foam layer onto the vertical members, the top member, and the bottom member of the frame assembly.

12. A method as set forth in claim 11 wherein the step of curing the structural foam layer is further defined as curing the structural foam layer on the vertical members, top member, and bottom member of the frame assembly and on the rigid foam insulating panel to couple the vertical members, top member, and bottom member together to form the frame member and to couple the rigid foam insulating panel to the frame assembly to form the high performance wall assembly, such that the high performance wall assembly is free of fasteners.

13. A method as set forth in claim 7 further comprising the step of spraying the structural foam layer onto the rigid foam insulating panel.

14. A wall assembly comprising:

a frame assembly having a top member, a bottom member opposite said top member, and a plurality of vertical members coupled to and extending between said top and bottom members with said frame assembly having an interior side and an exterior side opposite said interior side, wherein said top member, said bottom member, and said vertical members are made of wood;

a rigid foam insulating panel disposed adjacent to said exterior side of said frame assembly and extending from said exterior side of said frame assembly and terminating at an exterior surface of said rigid foam insulating panel;

a structural foam layer disposed between and adhered to said plurality of vertical members and adhered to an interior surface of said rigid foam insulating panel between said plurality of vertical members such that said plurality of vertical members are not encapsulated in said structural foam layer;

wherein said rigid foam insulating panel comprising a plurality of pre-expanded polymeric beads having multiple bead sizes and a binder, wherein said pre-expanded polymeric beads are selected from the group of polystyrene, styrene based-copolymers, polyethylene, polypropylene, polyesters, polyvinylchloride, cellulose acetate, and combinations thereof, wherein said binder is a polymer selected from the group of acrylic-based polymers or copolymers, styrene-acrylic-based copolymers, styrenebutadiene-based copolymers, vinyl acrylic-based copolymers, vinyl acetate based polymers or copolymers, polyvinylidene chloride, neoprene, natural rubber latex, and combinations thereof for binding the particles together, wherein said rigid foam insulating panel has a thickness of from about 0.5 to about 12 inches and a density of from about 0.5 to about 5.0 pounds per cubic foot;

an intermediate substrate disposed between said rigid foam insulating panel and said frame assembly with said rigid foam insulating panel bonded to said intermediate substrate and said intermediate substrate bonded to said structural foam layer for coupling to said frame assembly, wherein said intermediate substrate has a thickness of from about 0.125 to about 1.00 inches;

wherein said frame assembly has a first end and a second end spaced from said first end defining a length of the wall assembly;

an exterior covering disposed directly adjacent said exterior surface of said rigid foam insulating panel, said exterior covering being at least one of a siding panel, brick, and insulating foam panel; and wherein said structural foam layer adheres said rigid foam insulating panel to said frame assembly such that said rigid foam insulating panel is free of fasteners.

15. A high performance wall assembly as set forth in claim 14 wherein said intermediate substrate defines a plurality of holes with said structural foam layer disposed through said holes to contact said rigid foam insulating panel.

16. A high performance wall assembly as set forth in claim 14 wherein said intermediate substrate has a thickness of from about 0.125 to about 1.00 inches.

* * * * *